US006171062B1

(12) United States Patent
Bucher et al.

(10) Patent No.: US 6,171,062 B1
(45) Date of Patent: Jan. 9, 2001

(54) FITTING ADAPTED FOR HOLDING AN UPRIGHT COUPLING MEMBER DISPOSED IN A MOTOR CASING ONTO A FLAT CEILING WALL

(75) Inventors: John C. Bucher, Ft. Lauderdale; Charles E. Bucher, Valrico, both of FL (US)

(73) Assignee: King of Fans, Inc., Ft. Lauderdale, FL (US)

( * ) Notice: Under 35 U.S.C. 154(b), the term of this patent shall be extended for 0 days.

(21) Appl. No.: 09/408,451

(22) Filed: Sep. 20, 1999

(51) Int. Cl.[7] ..... F04D 29/64

(52) U.S. Cl. ..... 416/244 R; 416/5; 416/170 R; 416/246; 417/360; 417/423.15; 248/222.51; 248/222.52; 248/225.21; 248/345

(58) Field of Search ..... 416/5, 170 R, 416/244 R, 246; 417/360, 423.15; 362/96, 404; 248/222.51, 222.52, 225.21, 317, 345

(56) References Cited

U.S. PATENT DOCUMENTS

| | | | | |
|---|---|---|---|---|
| 1,270,296 | * | 6/1918 | Jeune | 248/345 |
| 1,511,914 | * | 10/1924 | Savory | 248/345 |
| 4,222,093 | * | 9/1980 | Garcia et al. | 362/404 |
| 4,729,725 | * | 3/1988 | Markwardt | 416/244 R |
| 5,613,832 | * | 3/1997 | Su | 416/244 R |
| 6,036,154 | * | 3/2000 | Pearce | 416/5 |

* cited by examiner

*Primary Examiner*—Christopher Verdier
(74) *Attorney, Agent, or Firm*—Holland & Knight LLP

(57) ABSTRACT

A fitting includes a mounting bracket to be fixed on a ceiling wall, and with two side edge portions opposite to each other to define an uppermost abutment plane. Two mounting walls extend downwards from the side edge portions, and have positioning walls axially spaced apart from the plane. An anchoring seat is disposed on one of the mounting walls immediately upstream of the positioning wall in a clockwise or counterclockwise direction, and is spaced apart from the plane with a width larger than that between the positioning wall and the plane. A protective covering member includes an upper annular secured portion, an anchored portion extending from the secured portion radially, inwardly and downwardly so as to engage the anchoring seat for suspending the covering member from the mounting bracket in a non-fastened state, and a supported portion extending from the secured portion radially and inwardly. When the secured portion is brought towards the plane from the non-fastened state, a subsequent adjustment of the position of the upper annular secured portion will shift the anchored portion to the positioning wall, thereby bringing the supported portion to sit on the other positioning wall so as to place the covering member in a ready state for fastening. In this state, fastening members can tighten the secured portion on the mounting walls.

17 Claims, 7 Drawing Sheets

FITTING ADAPTED FOR HOLDING AN UPRIGHT COUPLING MEMBER DISPOSED IN A MOTOR CASING ONTO A FLAT CEILING WALL

BACKGROUND OF THE INVENTION

1. Field of the Invention

This invention relates to ceiling fans. More particularly, this invention relates to a fitting adapted for holding an upright coupling member disposed in an upper wall of a motor casing onto a flat ceiling wall.

2. Description of the Background Art

Referring to FIG. 1, a conventional ceiling fan 10 is shown to include a mounting bracket 11 which has an upper major wall for mounting on a ceiling wall, and lateral mounting walls with screw holes 111. A protective canopy covering member 12 has an upper annular secured portion with through holes 121 such that screw fasteners 122 can pass through the through holes 121 and engage threadedly the screw holes 111 to tighten the protective covering member in the form of a canopy 12 on the mounting bracket 11. A motor casing 13 has a motor therein, and an upper wall which is disposed with a coupling member 131 that is secured on the protective covering member 12.

During assembly, since the protective covering member 12 is connected with the motor casing 13 before being secured on the mounting bracket 11 by the screw fasteners 122, the user needs to hold the protective covering member 12 using one hand to align the through holes 121 and the screw holes 111, and to position the screw fasteners 122 and to rotate the same using the other hand. The assembly as such is relatively inconvenient to conduct. More recent improvements have comprised J-shaped holes 121 that allow the weight of the canopy member 12 to be hung onto the screws 122 while the screws are then tightened.

Therefore, it is an object of this invention to provide an improvement which overcomes the aforementioned inadequacies of the prior art devices and provides an improvement which is a significant contribution to the advancement of the ceiling fan art.

Another object of this invention is to provide a fitting which facilitates assembly of a protective covering member in the form of a canopy to a mounting bracket of a ceiling fan.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a fitting which includes a mounting bracket and a protective covering member in the form of a canopy. The mounting bracket includes an upper major wall which is adapted to be fixed on and to abut against a ceiling wall, and which has two side edge portions opposite to each other to define an uppermost abutment plane in a radial direction relative to a first axis of an upright coupling member of a ceiling fan. Rightmost and leftmost mounting walls respectively extend downwards from the two side edge portions, and have positioning walls spaced apart from the uppermost abutment plane in an axial direction parallel to the first axis. The positioning walls extend parallel to the uppermost abutment plane and about the first axis so as to be angularly spaced from each other. In addition, one of the rightmost and leftmost mounting walls includes an anchoring seat which is disposed immediately upstream of the corresponding positioning wall in a clockwise or counterclockwise direction, and which is disposed to be spaced apart from the uppermost abutment plane with a width in the first axial direction that is larger than a width between the positioning wall and the uppermost abutment plane. A pair of arms are disposed to be spaced apart from each other in the radial direction for receiving and holding the upright coupling member.

The protective covering member in the form of a canopy includes an upper annular secured portion with an uppermost peripheral edge, a skirt portion which circumferentially extends from the annular secured portion about a second axis and downwardly for insertion of the upright coupling member, an anchored portion in the form of a hook which extends from the uppermost peripheral edge radially, inwardly and downwardly such that when the anchored portion is brought to engage the anchoring seat, the protective covering member will be suspended from the mounting bracket in a non-fastened state, and a supported portion in the form of a tab which extends from the uppermost peripheral edge radially and inwardly, and which is spaced from the anchored portion angularly. As such, when the uppermost peripheral edge is brought towards the uppermost abutment plane from the non-fastened state so as to bring the second axis to coincide with the first axis, a subsequent adjustment of the position of the upper annular secured portion relative to the rightmost and leftmost mounting walls in the clockwise or counterclockwise direction will shift the anchored portion to the corresponding positioning wall, thereby bringing the supported portion to sit on the other positioning wall so as to place the protective covering member in a ready state for fastening. In this state, a pair of fastening members can be disposed to tighten the upper annular secured portion on the rightmost and leftmost mounting walls.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
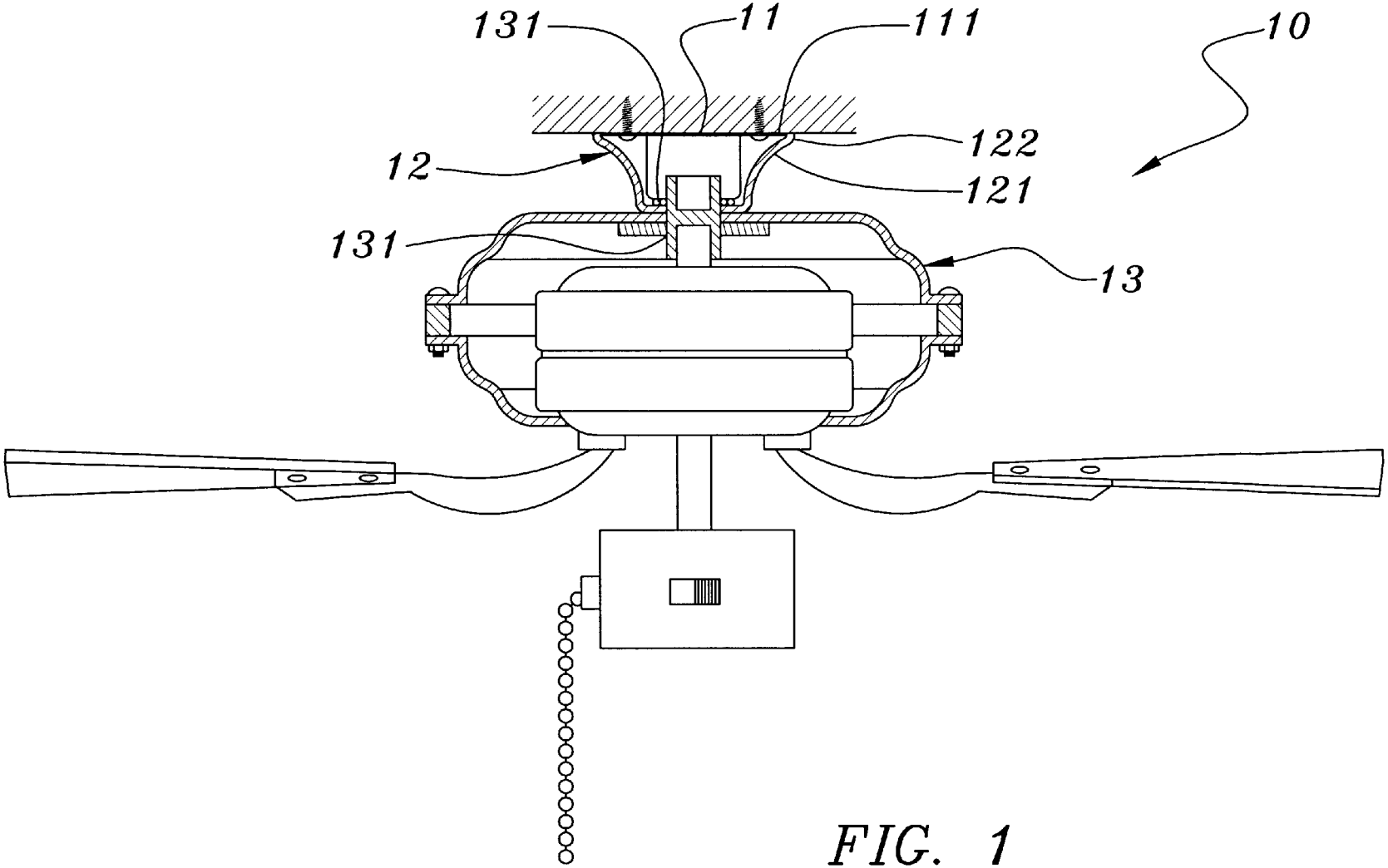
FIG. 1 PRIOR ART
FIG. 1 is a sectional view of a conventional ceiling fan.

Before the present invention is described in greater detail, it should be noted that the same reference numerals have been used to denote like elements throughout the specification.

Figure 2:
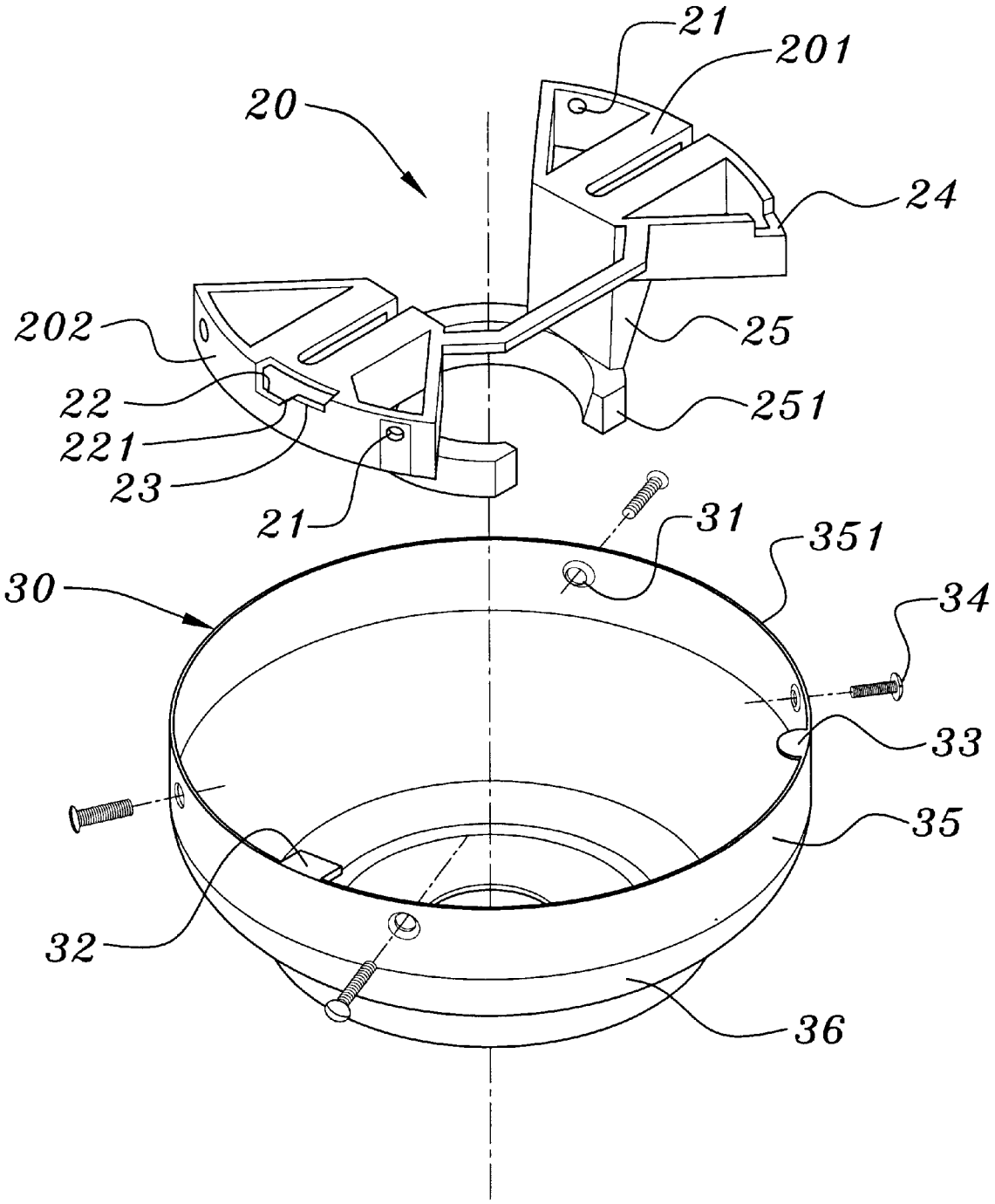
FIG. 2 is an exploded perspective view of a first preferred embodiment of a fitting according to this invention.
Figure 3:
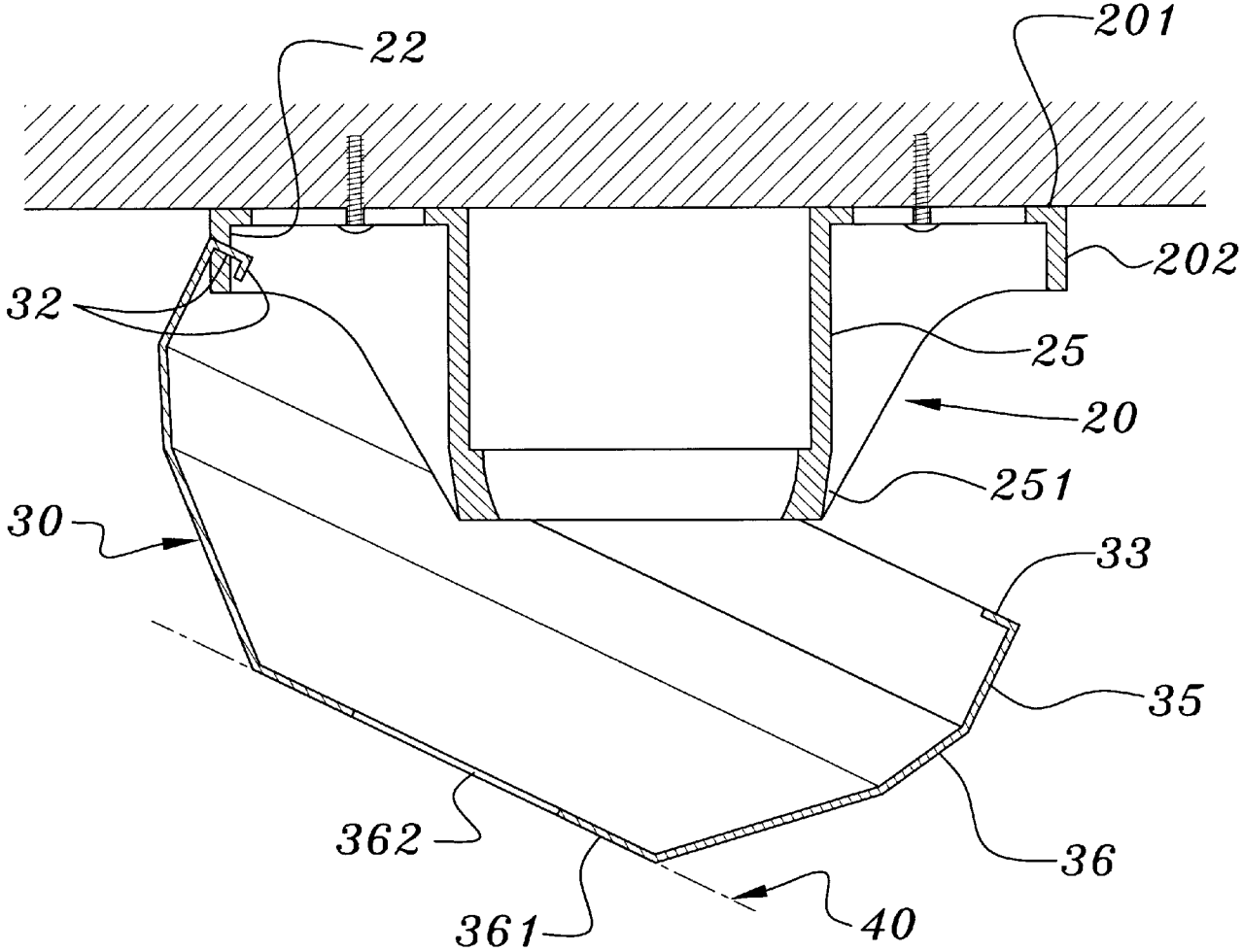
FIG. 3 is a sectional view showing the fitting of the first preferred embodiment in a non-fastened state.

Referring to FIGS. 2 and 3, the first preferred embodiment of the fitting according to the present invention is shown to comprise a mounting bracket 20, a protective canopy covering member 30 and a pair of fastening members.

The mounting bracket 20 includes an upper major wall 201 which is adapted to be fixed on and to abut against a flat ceiling wall, and which has two side edge portions opposite to each other to define an uppermost abutment plane in a radial direction relative to a first axis of an upright coupling member (not shown), which is disposed in an upper wall of a motor casing. Rightmost and leftmost mounting walls 202 respectively extend downwards from the two side edge portions of the upper major wall 201. Each of the rightmost and leftmost mounting walls 202 has a positioning wall 24,23 which is spaced apart from the uppermost abutment plane in an axial direction parallel to the first axis. The positioning walls 24,23 extend parallel to the uppermost abutment plane and about the first axis so as to be angularly spaced from each other. In addition, the leftmost mounting wall 202 further has an anchoring seat 22 which is disposed immediately upstream of the corresponding positioning wall 23 in a counterclockwise direction with an intervening inclining wall 221, and which is disposed to be spaced apart from the uppermost abutment plane with a width in the axial direction that is larger than a width between the positioning wall 23 and the uppermost abutment plane. Moreover, each of the rightmost and leftmost mounting walls 202 has a pair of screw holes 21 passing therethrough in the radial direction.

The mounting bracket 20 further includes a pair of arms 25 which are disposed to be spaced apart from each other in the radial direction and which are respectively inboard to the side edge portions of the upper major wall 201. Each arm 25 extends downwardly from the upper major wall 201 to form an engaging half 251 which is distal to the upper major wall 201 and which extends toward the other engaging half 251 in the radial direction to define a retaining bore functioning as a socket for receiving the ball of a downrod (not shown).

The protective covering member 30 includes an upper annular secured portion 35 with an uppermost peripheral edge 351, and a skirt portion 36 which circumferentially extends from the annular secured portion 35 about a second axis and downwardly to form a lower annular wall 361 that defines an opening 362 for insertion of the upright coupling member. In addition, an anchored portion in the form of a hook 32 is disposed to extend from the uppermost peripheral edge 351 of the upper annular secured portion 35 radially, inwardly and downwardly. A supported portion in the form of a tab 33 is disposed to extend from the uppermost peripheral edge 351 of the upper annular secured portion 35 radially and inwardly, and is spaced from the anchored portion 32 angularly. Moreover, the upper annular secured portion 35 further has two pairs of through holes 31 extending therethrough in a second radial direction relative to the second axis.

Each fastening member includes a pair of screw fasteners 34 (preferably flat-headed), each of which can pass through the respective through hole 31 and engage threadedly the respective screw hole 21.

As illustrated in FIG. 3, when the anchored portion 32 of the protective covering member 30 is brought to engage with the anchoring seat 22 of the leftmost mounting wall 202, the protective covering member 30 will be suspended from the mounting bracket 20 in a non-fastened state. While temporarily hanging in this position, the ceiling fan 10 may be conveniently wired to the household electrical wiring.

Figure 4:
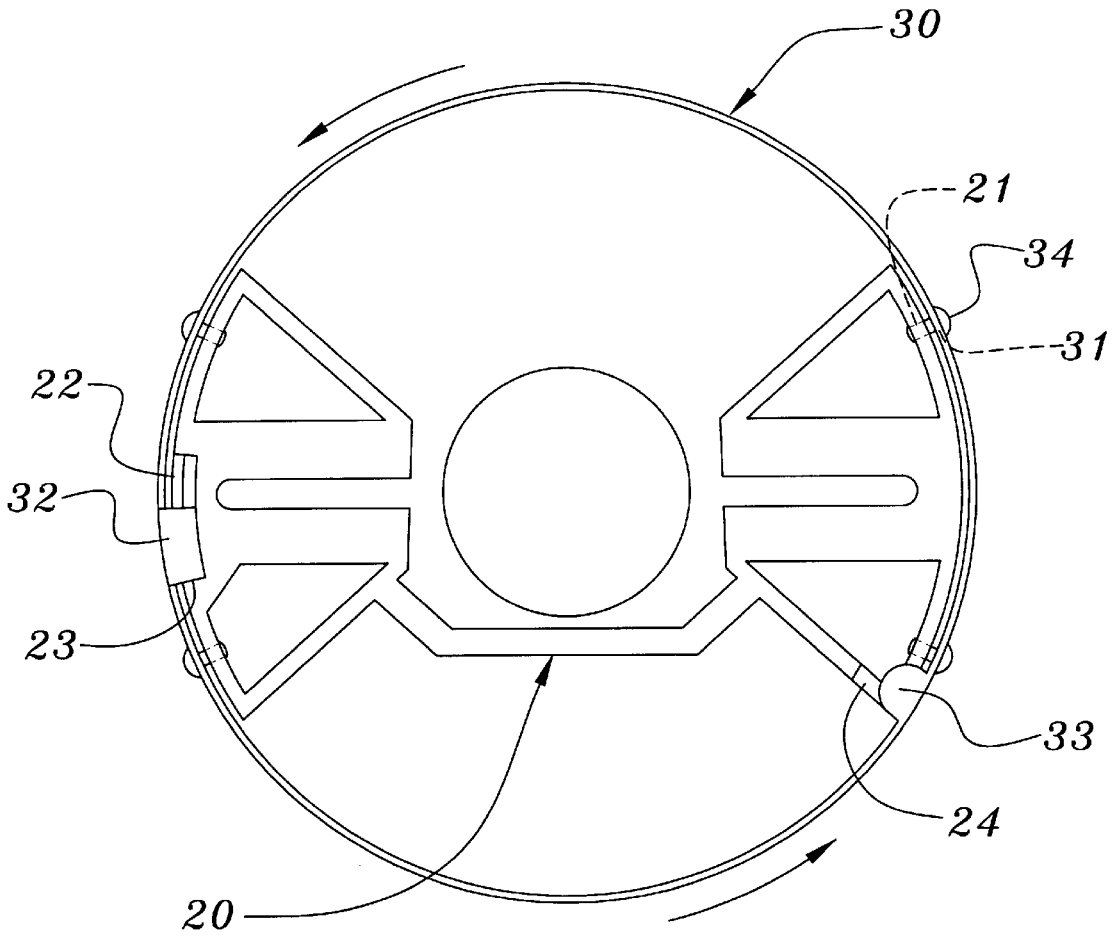
FIG. 4 is a top view showing the fitting of the first preferred embodiment in a fastened state.

Subsequently, the uppermost peripheral edge 351 of the protective covering member 30 is brought towards the uppermost abutment plane from the non-fastened state so as to bring the second axis to coincide with the first axis. With reference to FIG. 4, a subsequent adjustment of the position of the upper annular secured portion 35 relative to the rightmost and leftmost mounting walls 202 in the counterclockwise direction will shift the anchored portion 32 to the positioning wall 23 of the leftmost mounting wall 202, thereby bringing the supported portion 33 to sit on the positioning wall 24 of the rightmost mounting wall 202 so as to place the protective covering member 30 in a ready state for fastening. In this state, the user can conveniently use the screw fasteners 34 to tighten the upper annular secured portion 35 against the rightmost and leftmost mounting walls 202.

Figure 5:
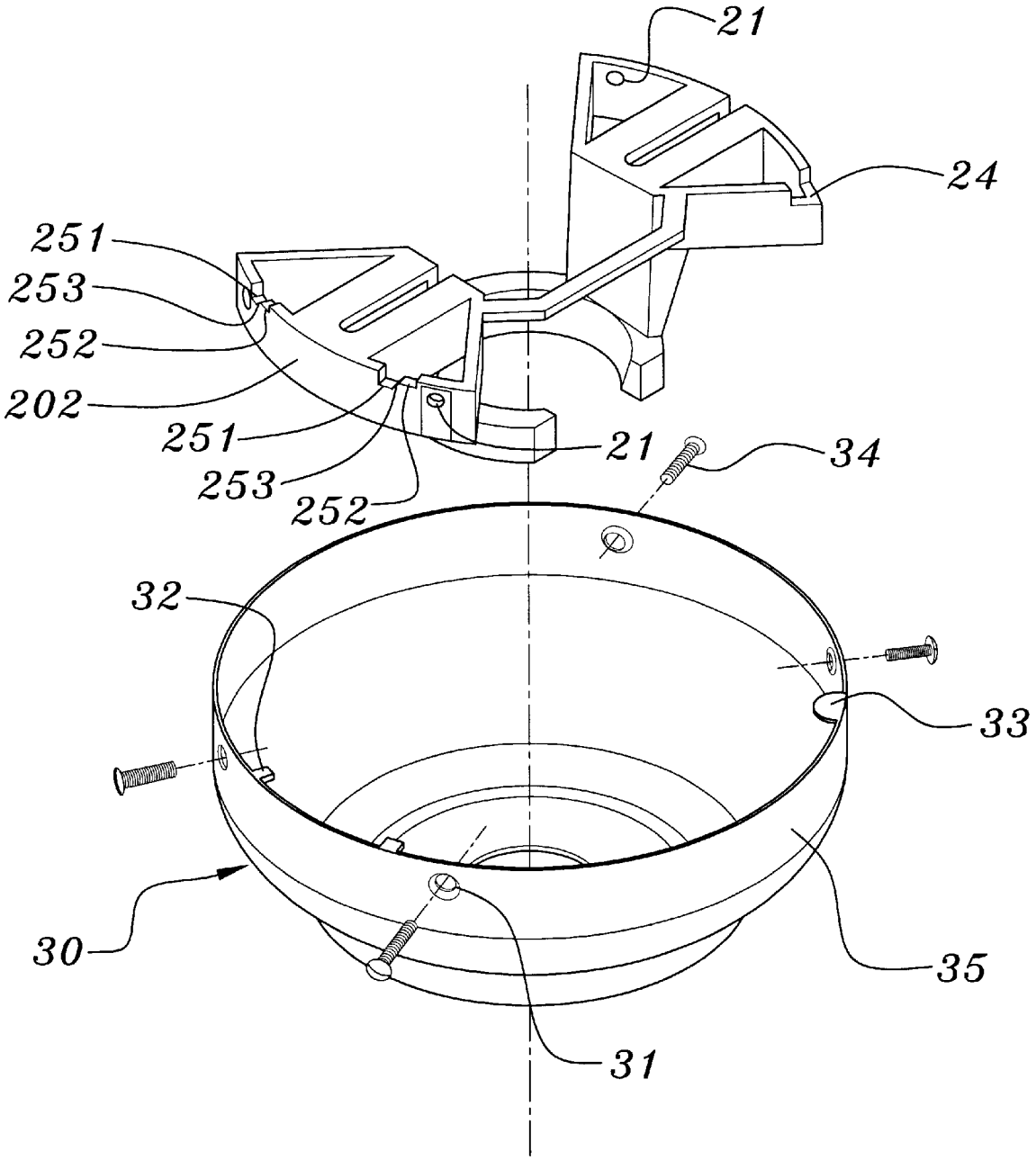
FIG. 5 is an exploded perspective view of a second preferred embodiment of a fitting according to this invention.
Figure 6:
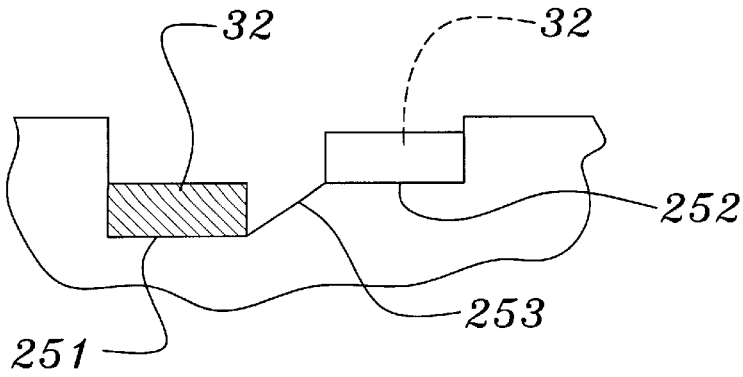
FIG. 6 is a schematic view showing the fitting of the second preferred embodiment when shifted from a non-fastened state toward a ready state.
Figure 7:
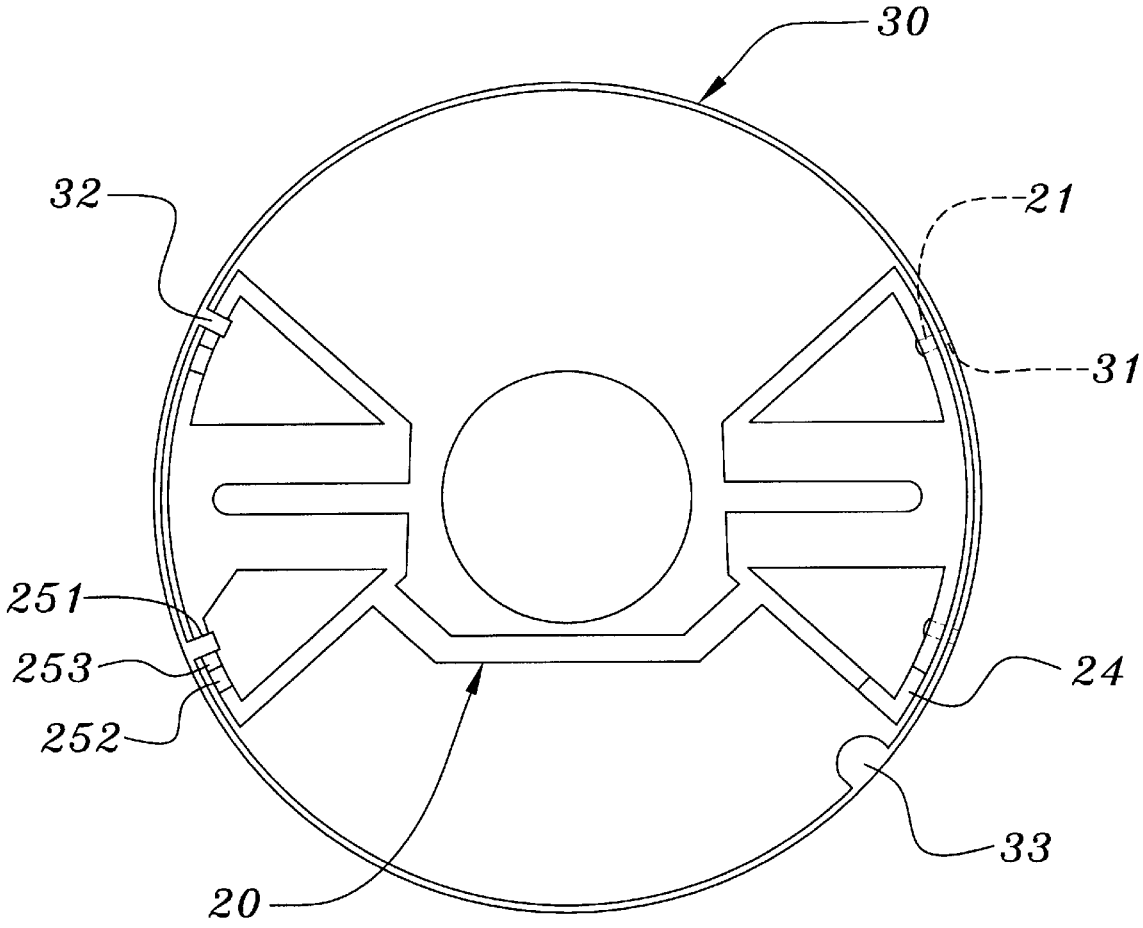
FIG. 7 is a top view showing the fitting of the second preferred embodiment in the non-fastened state.
Figure 8:
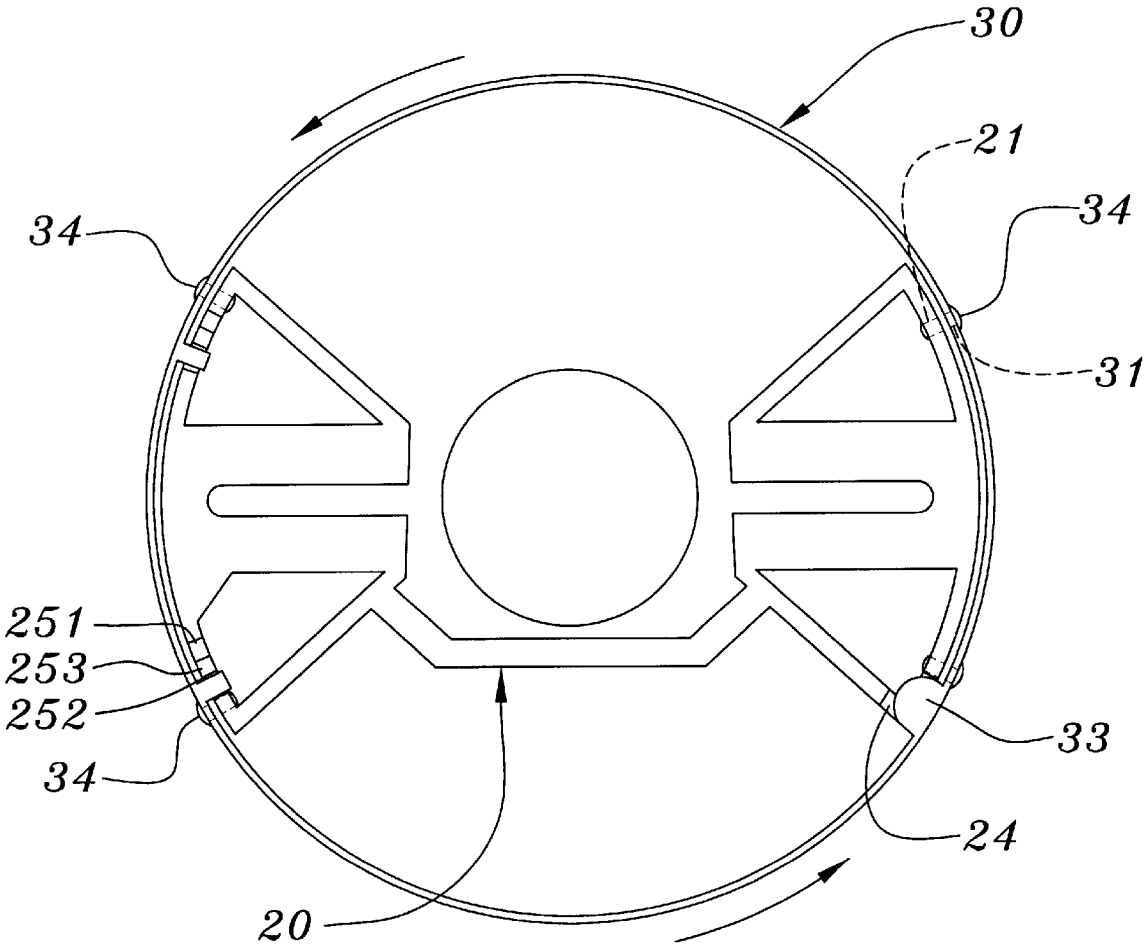
FIG. 8 is a top view showing the fitting of the second preferred embodiment in a fastened state.

Referring to FIG. 5, the second preferred embodiment of the fitting according to this invention is shown. The difference with the first preferred embodiment resides in that the leftmost mounting wall 202 of the mounting bracket 20 has two anchoring seats 251 similar to the anchoring seat 22 shown in FIG. 2, two positioning walls 252 similar to the positioning wall 23 shown in FIG. 2, and two inclining walls 253 respectively disposed between the positioning walls 252 and the anchoring seats 251. In addition, the protective covering member 30 has two anchored portions 32 so as to respectively engage the anchoring seats 251 in the non-fastened state (as shown in FIG. 7) and to be shifted by guidance of the inclining walls 253 to the positioning walls 252 in the ready state (as shown in FIGS. 6 and 8). The screw fasteners 34 can pass through the through holes 31 and engage threadedly the screw holes 21, as shown in FIG. 8.

As such, before being secured on the mounting walls 202 by the screw fasteners 34, the upper annular secured portion 35 of the protective covering member 30 can be brought to be held thereon by the engagement between the anchored portions 32 and the positioning walls 252 and between the supported portion 33 and the positioning wall 24, thereby resulting in convenience during the securing operation of the screw fasteners 34.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A fitting adapted for holding an upright coupling member, which extends in a first axis and which is disposed in an upper wall of a motor casing and coaxial to a rotor shaft of a ceiling fan, onto a flat ceiling wall, said fitting comprising:

(a) a mounting bracket including (i) an upper major wall adapted to be fixed on and to abut against the ceiling wall, and having two side edge portions opposite to each other to define an uppermost abutment plane in a radial direction relative to the first axis, and (ii) rightmost and leftmost mounting walls respectively extending downwards from said two side edge portions, at least one of said rightmost and leftmost mounting walls having a positioning wall which is spaced apart from said uppermost abutment plane in an axial direction parallel to the first axis, and which extends parallel to said uppermost abutment plane and about the first axis, and an anchoring seat which is disposed immediately upstream of said positioning wall in a clockwise or counterclockwise direction and which is disposed to be spaced apart from said uppermost abutment plane with a width in the first axial direction that is larger than a width between said positioning wall and said uppermost abutment plane;

(b) a protective covering member including (i) an upper annular secured portion with an uppermost peripheral edge, (ii) a skirt portion circumferentially extending from said annular secured portion about a second axis and downwardly to form a lower annular wall which defines an opening adapted for insertion of the upright coupling member, (iii) an anchored portion extending from said uppermost peripheral edge of said upper annular secured portion radially, inwardly and downwardly such that when said anchored portion is brought to engage with said anchoring seat, said protective covering member will be suspended from said mounting bracket in a non-fastened state, and when said anchored portion is brought to engage said positioning wall, said uppermost peripheral edge can be brought towards said uppermost abutment plane so as to place said protective covering member in a ready state for fastening; and (c) a pair of fastening members, each disposed to bring said upper annular secured portion towards a respective one of said rightmost and leftmost mounting walls so as to tighten said upper annular secured portion against said respective one of said rightmost and leftmost mounting walls when said protective covering member is in the ready state.

2. The fitting as claimed in claim 1, wherein each of said fastening members includes a pair of screw fasteners passing through said upper annular secured portion and engaging threadedly said respective one of said rightmost and leftmost mounting walls.

3. The fitting as claimed in claim 1, wherein said at least one of said rightmost and leftmost mounting walls further has an inclining wall disposed between and interconnecting said positioning wall and said anchoring seat.

4. A fitting adapted for holding an upright coupling member, which extends in a first axis and which is disposed in an upper wall of a motor casing and coaxial to a rotor shaft of a ceiling fan, onto a flat ceiling wall, said fitting comprising:

(a) a mounting bracket including (i) an upper major wall adapted to be fixed on and to abut against the ceiling wall, and having two side edge portions opposite to each other to define an uppermost abutment plane in a radial direction relative to the first axis, and (ii) rightmost and leftmost mounting walls respectively extending downwards from said two side edge portions, each having a positioning wall spaced apart from said uppermost abutment plane in an axial direction parallel to the first axis, said positioning walls extending parallel to said uppermost abutment plane and about the first axis so as to be angularly spaced from each other, one of said rightmost and leftmost mounting walls including an anchoring seat which is disposed immediately upstream of a corresponding one of said positioning walls in a clockwise or counterclockwise direction and which is disposed to be spaced apart from said uppermost abutment plane with a width in the first axial direction that is larger than a width between said corresponding one of said positioning walls and said uppermost abutment plane;

(b) a protective covering member including (i) an upper annular secured portion with an uppermost peripheral edge, (ii) a skirt portion circumferentially extending from said annular secured portion about a second axis and downwardly to form a lower annular wall which defines an opening adapted for insertion of the upright coupling member, (iii) an anchored portion extending from said uppermost peripheral edge of said upper annular secured portion radially, inwardly and downwardly such that when said anchored portion is brought to engage with said anchoring seat, said protective covering member will be suspended from said mounting bracket in a non-fastened state, and (iv) a supported portion extending from said uppermost peripheral edge of said upper annular secured portion radially and inwardly, and spaced from said anchored portion angularly such that when said uppermost peripheral edge is brought towards said uppermost abutment plane from the non-fastened state so as to bring the second axis to coincide with the first axis, a subsequent adjustment of the position of said upper annular secured portion relative to said rightmost and leftmost mounting walls in the clockwise or counterclockwise direction will shift said anchored portion to said corresponding one of said positioning walls, thereby bringing said supported portion to sit on the other one of said positioning walls so as to place said protective covering member in a ready state for fastening; and (c) a pair of fastening members, each disposed to bring said upper annular secured portion towards a respective one of said rightmost and leftmost mounting walls so as to tighten said upper annular secured portion against said respective one of said rightmost and leftmost mounting walls when said protective covering member is in the ready state.

5. The fitting as claimed in claim 4, wherein each of said fastening members includes a pair of screw fasteners passing through said upper annular secured portion and engaging threadedly said respective one of said rightmost and leftmost mounting walls.

6. The fitting as claimed in claim 4, wherein said at least one of said rightmost and leftmost mounting walls further has an inclining wall disposed between and interconnecting said positioning wall and said anchoring seat.

7. A ceiling fan bracket and canopy assembly for a ceiling fan, comprising in combination:

a ceiling fan bracket for mounting to a ceiling, said bracket including a first and a second mounting wall, said first mounting wall including a first positioning wall, said second mounting wall including a second positioning wall, said first mounting wall further including an anchoring seat positioned upstream of said first positioning wall;

a ceiling fan canopy for mounting to said bracket, said canopy including an upper annular secured portion from which extends inwardly an anchored portion and a supported portion, said anchored portion and said supported portion being aligned relative to said first positioning wall and said second positioning wall, respectively, whereby said anchored portion may be seated in said anchoring seat to suspend said canopy from said bracket to facilitate wiring of the ceiling fan whereupon said canopy may then be leveled to be aligned with said bracket and then twisted so as to move said anchored portion and said supported portion into alignment with and to be rested upon said first positioning wall and said second positioning wall, respectively.

8. The ceiling fan bracket and canopy assembly as set forth in claim 7, wherein said anchored portion comprises a hook.

9. The ceiling fan bracket and canopy assembly as set forth in claim 8, wherein said hook is configured and dimensioned to hook over said anchoring seat.

10. The ceiling fan bracket and canopy assembly as set forth in claim 9, wherein said hook extends from an uppermost peripheral edge of said canopy.

11. The ceiling fan bracket and canopy assembly as set forth in claim 7, wherein said supported portion comprises a tab.

12. The ceiling fan bracket and canopy assembly as set forth in claim 11, wherein said tab extends from an uppermost peripheral edge of said canopy.

13. The ceiling fan bracket and canopy assembly as set forth in claim 7, wherein said bracket further includes a plurality of first positioning walls with upstream-positioned anchoring seats and wherein said canopy further includes a corresponding plurality of said anchored portions in alignment therewith.

14. The ceiling fan bracket and canopy assembly as set forth in claim 7, wherein said bracket further includes a plurality of second positioning walls and wherein said canopy further includes a corresponding plurality of said supported portions in alignment therewith.

15. The ceiling fan bracket and canopy assembly as set forth in claim 7, wherein said bracket further comprises an inclining wall positioned between said anchoring seat and said first positioning wall.

16. The ceiling fan bracket and canopy assembly as set forth in claim 7, further comprising a fastener for coupling said canopy to said bracket after the canopy is twisted into level position with said bracket.

17. The ceiling fan bracket and canopy assembly as set forth in claim 16, wherein said fastener comprises a threaded fastener that engages through corresponding holes in said canopy and said bracket.

* * * * *